United States Patent [19]

Sternling

[11] Patent Number: 4,979,964

[45] Date of Patent: Dec. 25, 1990

[54] APPARATUS FOR PREVENTING SLAG TAP BLOCKAGE

[75] Inventor: Charles V. Sternling, Houston, Tex.

[73] Assignee: Shell Oil Company, Houston, Tex.

[21] Appl. No.: 369,871

[22] Filed: Jun. 22, 1989

[51] Int. Cl.[5] ..... C10J 3/52

[52] U.S. Cl. ..... 48/62 R; 48/63; 48/69; 48/87; 48/DIG. 2

[58] Field of Search ..... 48/77, 69, 63, 62 R, 48/87, 210, DIG. 2, 203, 206; 110/165 R, 171; 266/45, 236

[56] References Cited

U.S. PATENT DOCUMENTS

| | | | |
|---|---|---|---|
| 4,119,411 | 10/1978 | Anderson et al. | 48/62 R |
| 4,126,427 | 11/1978 | Eales | 48/62 R |
| 4,129,422 | 12/1978 | Wood | 48/62 R |
| 4,177,042 | 12/1979 | Wood | 48/87 |
| 4,192,654 | 3/1980 | Brooks | 48/62 R |
| 4,195,978 | 4/1980 | Anderson | 48/62 R |
| 4,300,913 | 11/1981 | Egert et al. | 48/67 |
| 4,479,809 | 10/1984 | Johnson et al. | 48/77 |
| 4,520,737 | 6/1985 | Van Kessel | 110/171 |
| 4,653,677 | 3/1987 | Peters et al. | 222/591 |
| 4,680,035 | 7/1987 | Tanca | 48/77 |
| 5,610,697 | 9/1986 | Darling et al. | 48/77 |

*Primary Examiner*—Peter Kratz

[57] ABSTRACT

The slag tap of a gasifier is offset from the geometrical axis. Coalescent, molten, residual ash from incomplete combustion is directed to a hearth where residence time provides further combustion and a reduction in the volume and temperature of the resulting slag. The reduced volume and temperature ash is then directed to a slag tap after which disposal is accomplished by conventional means.

1 Claim, 3 Drawing Sheets

FIG. 5A
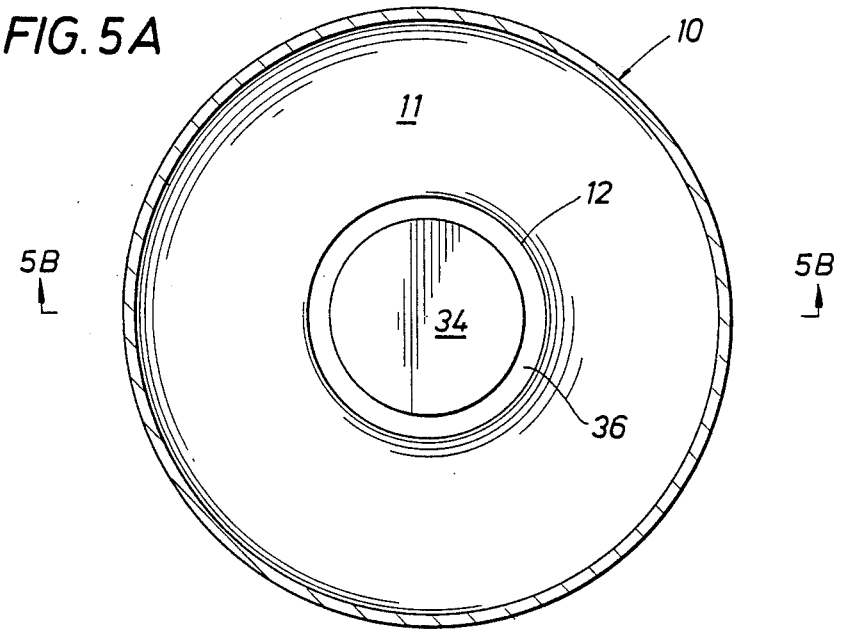
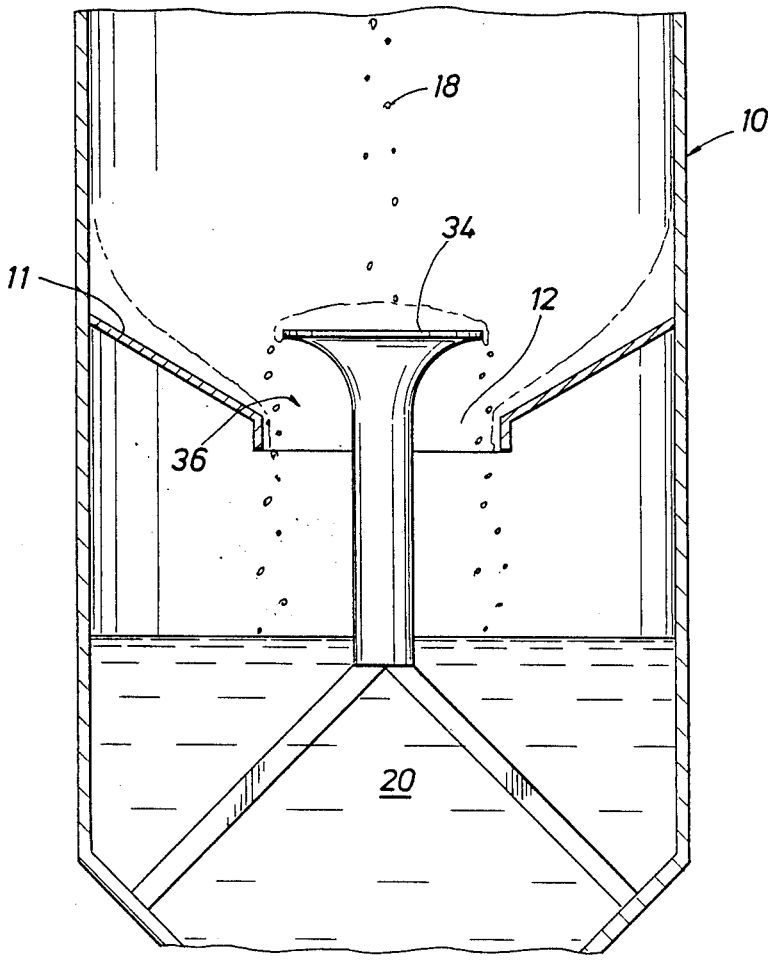
FIG. 5B

APPARATUS FOR PREVENTING SLAG TAP BLOCKAGE

BACKGROUND OF THE INVENTION

This invention relates to a process for the partial or complete combustion of carbon-containing fuel with an oxygen-containing gas in a reactor under high pressures and temperatures in which the gas formed is removed at the top of the reactor and slag is removed at the bottom of the reactor. The invention also relates to a reactor for use in the process or to other processes wherein a liquid material with solidifying propensity is discharged from a bottom orifice.

Since the carbon-containing fuel is usually of mineral origin, it invariably also contains, in addition to carbon and hydrogen, a certain quantity of inorganic incombustible material, often referred to by the term "ash," which is separated during the complete or partial combustion of the mineral fuel. The residual ash collects as a molten slag and iron in the hearth of the reactor from which it is discharged (commonly known as slag-tapping) downwardly through a slag tap outlet or orifice in the hearth into water contained in a quenching chamber, or water bath, therebelow. The waste slag is then removed from the water bath by conventional means.

Various types of coal contain characteristically different quantities of residual ash and therefore produce different amounts of molten slag. Also, the rheology of the slag may differ from type to type. A slag tap of a fixed size for a particular coal, producing a characteristic quantity of slag of characteristic rheology, may be too small to accommodate another coal having a larger residual ash content and therefore producing a larger quantity of slag or a slag having different rheological characteristics. The larger quantity of slag could block the slag tap orifice and prevent satisfactory slag tapping operation. Thus, the type of coal gasified in the reactor is limited, in part, by the size of the slag tap orifice.

The art is therefore replete with attempts to prevent the accumulation of slag and blockage of the slag tap. For example, Assignee's U.S. Pat. No. 4,834,778 is directed to a method and apparatus for determining the onset of slag tap blockage, and copending application Ser. No. 114,979 filed Oct. 30, 1987 is directed to an interchangeable slag tap, the size of which can be easily changed for differing types of fuel. Assignee's U.S. Pat. No. 4,520,737 is directed to a slag tap cleaner whereby the slag tap may be cleaned (i.e., reamed) without interrupting the combustion process. U.S. Pat. No. 4,680,035 assigned to Combustion Engineering discloses a two-stage slagging gasifier which minimizes back-mixing of reductor gas into the combustor. U.S. Pat. No. 4,479,809 to Texaco is directed to a swirling flow slag trap. Dow Chemical patent No. 4,653,677 is directed to a slag tap outlet. British Gas patent Nos. 4,192,654, 4,129,422, 4,177,042, 4,195,978, 4,126,427 and 4,119,411 are directed to various slag tap designs, including removable hearths. U.S. Pat. No. 4,300,913, of Russian origin, is directed to a double-walled discharge tube. All of these systems, and all others known to Applicant, have one feature in common, i.e., a slag tap centrally located in the reactor. They also have one problem in common, i.e., potential blockage of the slag tap.

The present invention is directed to overcoming this and other related problems in the prior art.

Applicant is not aware of any prior art which, in his judgment as a person skilled in this particular art, would anticipate or render obvious the present invention. However, for the purposes of fully developing the background of the invention and establishing the state of requisite art, the art noted above is set forth.

SUMMARY OF THE INVENTION

The primary purpose of the present invention relates to operating a gasifier preferably having the capability of using various types of coal having different mineral content.

As noted above, coal can be efficiently converted to synthesis gas by reacting it with an oxygen-containing gas in an entrained-flow coal gasification reactor. For economical and high efficiency operation, the reactor is best operated at a temperature which is high enough to convert the ash in the coal to a molten, free-flowing slag which is then removed by allowing it to flow out of a "slag tap" at the lowest part of the reactor vessel.

During this process, a jet of fluid, formed by coalescence of the individual jets from the separate burners, is likely to be formed on the center line of the reactor and to be directed vertically downwards. If the slag tap is itself located on the center line of the reactor, the hot fluid containing unconverted coal can fall unimpeded and enter the chambers below the reactor causing excessive heat losses and excessive loss of unconverted carbon. By locating the slag tap at a position off of the reactor center line, this bypassing of poorly reacted material is reduced significantly.

Preferably, such an apparatus includes:

a gasifier of sufficient volume to permit conversion of at least 98% of the fuel fed to it;

means for introducing a dry fuel in finely divided form into the gasifier;

a slag tap for removing fluid slag from the gasifier while limiting upward or downward flow of particle-containing gases through the slag tap; and means for solidifying and collecting the mineral matter in the feed solids.

Preferably, such a method includes:

introducing a dry fuel in finely divided form into a gasifier;

converting mineral matter in the dry fuel into a free-flowing liquid;

removing the liquid by means of a slag tap;

limiting upward or downward flow of particle-containing gases through the slag tap; and solidifying and collecting the residual waste mineral matter.

BRIEF DESCRIPTION OF THE DRAWINGS

FIGS. 5A and 5B illustrate an annular slag tap including a pedestal.

DESCRIPTION OF THE PREFERRED EMBODIMENTS

Figure 1:
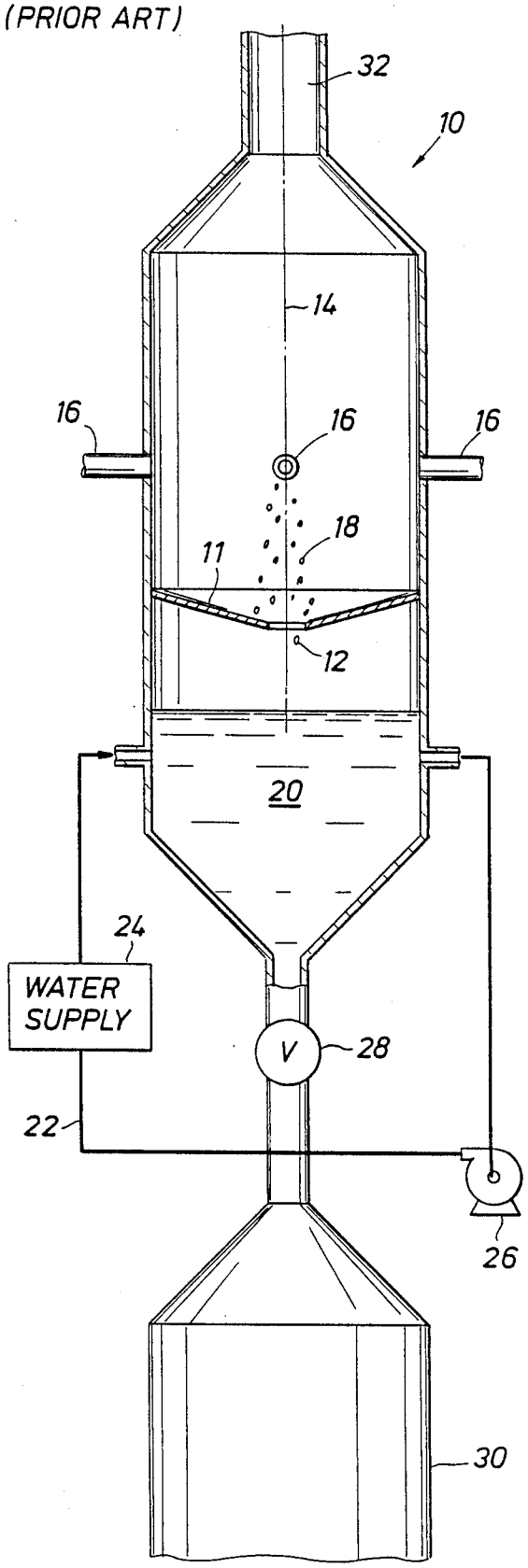
FIG. 1 (PRIOR ART)
FIG. 1 illustrates a schematic elevation of a prior art device.

Generation of synthesis gas occurs by the combustion or partial oxidation of carbon-containing fuel, such as coal, at relatively high temperatures in the range of 800° to 2000° C. and at a pressure range of from about 1–200 bar in the presence of oxygen or oxygen-containing gases in a reactor known as a gasifier, hereinafter referred to as a gasifier. Oxygen-containing gases include air, oxygen-enriched air, and oxygen, optionally diluted with steam, carbon dioxide and/or nitrogen.

The combustion may be complete or partial, the object of the combustion process being the production of synthesis gas (sometimes called "syngas") as a clean fuel for power generation or as feedstock for downstream process plants. The process preferably converts about 98% of the fuel fed to the reactor.

In the present invention, the ash, which is the inorganic, incombustible material, is separated from the fuel during the combustion or partial oxidation of the mineral fuel. Depending on the operating conditions under which the reactions take place, in particular the temperature with respect to the quality of the fuel, the ash is mainly obtained in solid or liquid condition or in a combination thereof. The larger part of the liquid ash obtained, further referred to as slag, deposits on the gasifier wall and hearth, flows along the gasifier hearth and through a discharge opening, often referred to as slag tap, and is generally collected in a water bath located below the slag tap of the gasifier, where the slag is cooled, solidified and subsequently discharged.

The slag tap should be rather narrow for various reasons. First, the escape of unconverted coal through the discharge opening should be avoided as much as possible. Second, the slag discharge opening should prevent water vapor, formed during the cooling of the slag in the water bath, from entering the gasifier in excessive quantities. The penetration of the water vapor into the gasifier could unfavorably affect the combustion process when it enters the reactor in substantial quantities. It should further prevent the periodic alternate in-flow and out-flow of hot gases to the slag bath chamber. Such flows of water vapor or product gases will have a solidifying effect on the slag in the gasifier resulting in the slag flow to the slag discharge opening being reduced.

Depending upon the conditions in the gasifier, such as the quantity of residual ash in the carbon-containing fuel being used, the slag will more or less easily flow to the slag tap and subsequently enter the cooling water bath. However, if the slag flow through the slag tap is reduced it may cause blockage of the slag tap. If the slag tap becomes blocked, the slag will accumulate in the reaction zone and the combustion or partial oxidation process must be interrupted to clean the slag tap. Apart from the loss of production involved in interrupting the process, there is also poor accessibility of the gasifier owing to the high process temperature and pressure, which will result in the cleaning of the slag tap being a complicated, expensive and time consuming matter.

A primary advantage of the present invention is preventing blockage of the slag tap and thus extending the time periods between shutdown of the gasifier.

A second advantage of the present invention is preventing blockage of the slag tap initiated by the breaking away of massive solidified slag formed in or near the top exit of the reactor. A lump of slag which breaks away tends to fall vertically downward, impacting at the center of the reactor floor and initiates plugging of any centrally located slag tap.

A third advantage of the present invention is the reduction of unconverted carbon resulting from the centrally located, downward-directed jet of fluid formed by convergence of the feed streams. This jet, if unimpeded, carries coal particles through the gasifier in times much shorter than the average time spent by coal particles in the gasifier. Such particles are incompletely converted and can pass through a centrally located slag tap into the slag bath chamber, separate there into the water bath and hence become lost to further gasification processes. The eccentrically located slag tap markedly reduces this loss of potential gasification reactants.

Although this invention is described hereinafter primarily with reference to particulate coal, the method and apparatus according to the invention are also suitable for other finely divided particulate reactive solids such as those which can be combusted or partially oxidized as, for example, lignite, anthracite, bituminous, brown coal, soot, petroleum coke, and the like. Preferably, the size of the solid carbonaceous feedstock is such that about 90 percent by weight of the fuel has a particle size smaller than 100 mesh (A.S.T.M.).

Having thus generally described the apparatus and method of the present invention, as well as its numerous advantages over the art, the following is a more detailed description thereof, given in accordance with specific reference to the drawings. However, the drawings are of the process flow type in which auxiliary equipment, such as pumps, compressors, cleaning devices, etc., are not shown. All values are merely exemplary or calculated.

FIG. 1 represents a prior art gasifier 10 having the usual slag tap 12 placement which is generally on the geometric axis 14 of the gasifier 10 and hearth 11. Particulate coal is injected into the burners 16 which are generally directed on a radial of the gasifier and converge at the axis thereof. As the fuel is converted by combustion, residual ash (unconverted carbon) falls toward the slag tap 12. A jet of fluid 18, formed by coalescence of the individual jets from the separate burners 16 is formed on the center line 14, or axis, of the gasifier and is directed generally vertically downwards. This hot fluid 18, containing unconverted coal, is directed through the slag tap 12 opening and into the water bath or quench chamber 20 below the reactor 10. Cooling water is circulated through line 22 from a supply 24 by means of a pump 26. The water bath 20 disintegrates and freezes the slag nodules. The slag nodules may be removed periodically by means of valve 28 and tank 30. Synthesis gas is removed through a gas outlet 32 in the roof of the reactor 10. The result of this is (1) excessive heat loss due to recirculation of part of the hot gas downward through the slag tap 12 opening and then upward and back through the slag tap 12 opening, and (2) excessive loss of unconverted, or poorly reacted, carbon.

Figure 2:
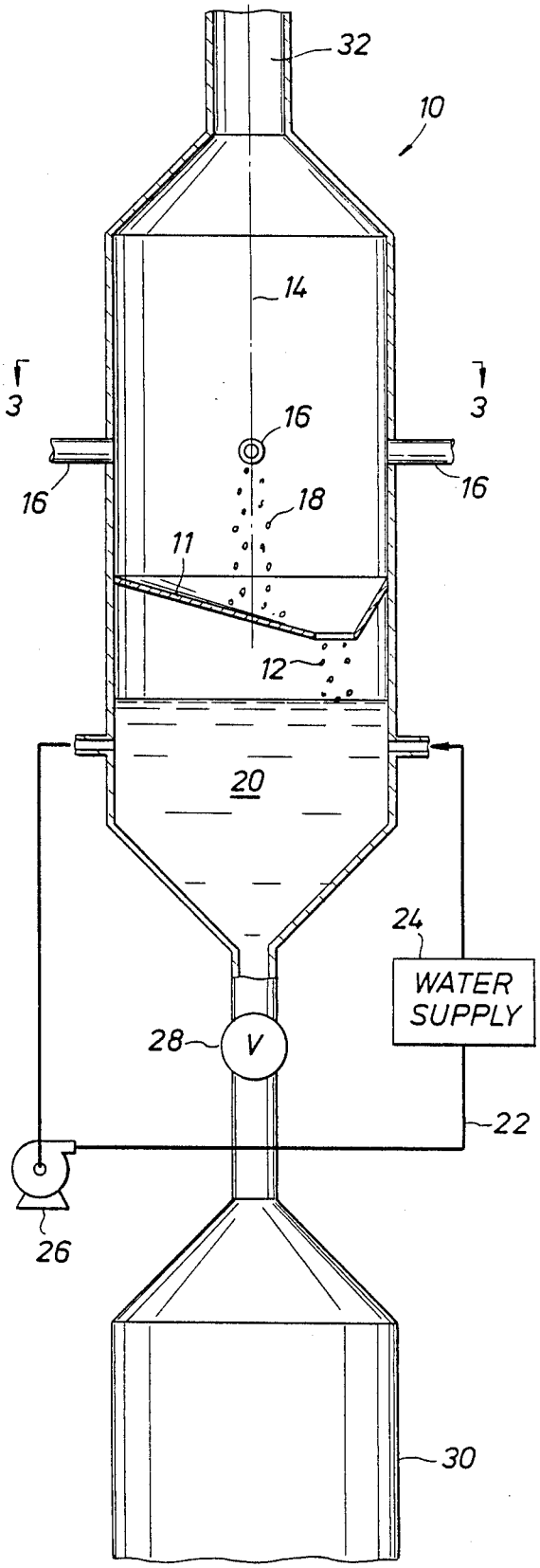
FIG. 2 illustrates a reactor utilizing a preferred embodiment of the invention.

FIG. 2 illustrates a gasifier 10 utilizing a preferred embodiment of the present invention. The slag tap 12 is offset from the center line 14 or axis of the gasifier 10. The molten residual ash 18, instead of falling directly through the slag tap 12, is directed to the hearth 11 of the gasifier 10 where further conversion takes place because of the increased residence time in the gasifier 10. The resulting slag, which has less volume, which contains less carbon, and which is cooler (because of increased conversion) than prior art devices, is directed by the slope of the hearth 11 toward the slag tap outlet 12 and into the quench chamber 20. The slope of the hearth 11 is preferably about 0°–30° from the horizontal.

Figure 3:
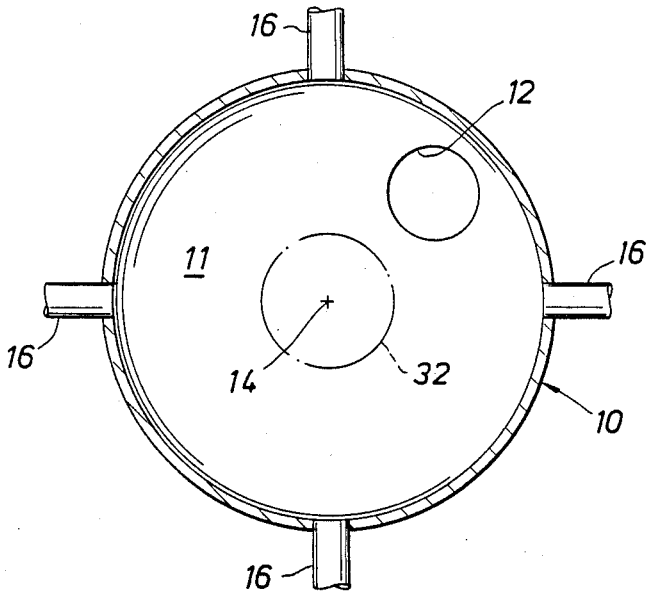
FIG. 3 illustrates a plan view of FIG. 2 utilizing a circular slag tap.
Figure 4A:
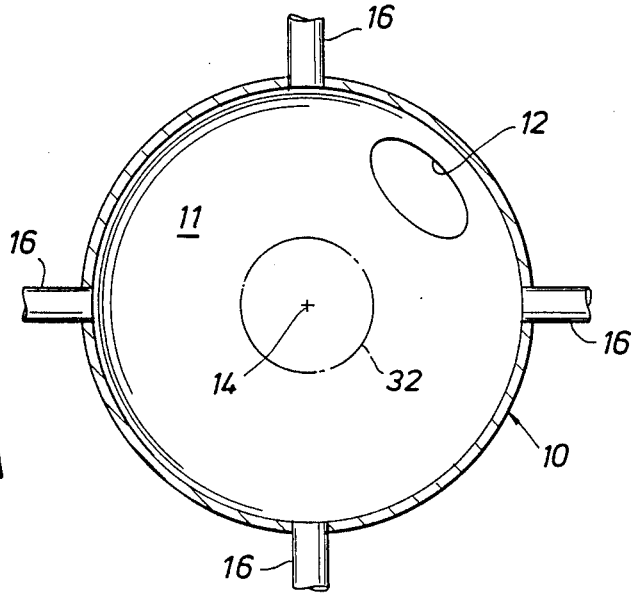
FIGS. 4A and 4B illustrate plan views of variations in the slag tap configuration.
Figure 4B:
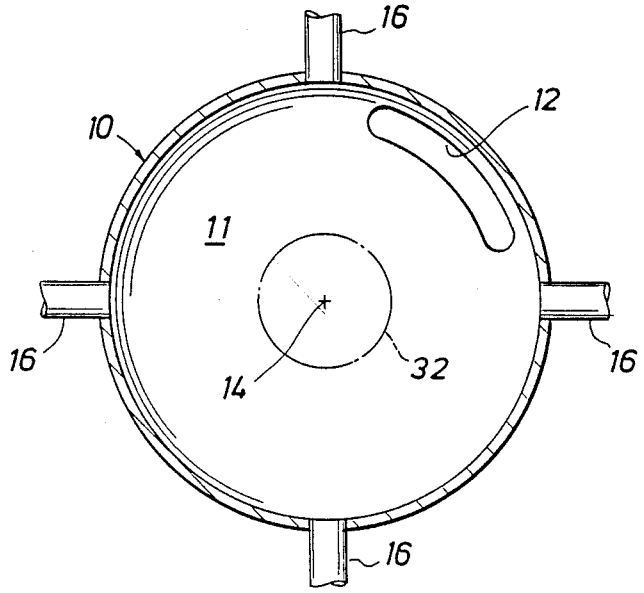

FIG. 3 illustrates a gasifier 10 utilizing a circular slag tap 12 located far from the reactor center line 14. FIGS.

4A and 4B illustrate, respectively, an oval and an arcuate (curved) slag tap 12, the outer edges of which are located close to the gasifier 10 wall. The oval slag tap 12 preferably has a ratio of major to minor axes of from about 1.1 to 3.0. The slag taps 12 are preferably offset from the gasifier 10 centerline by a distance of about 0.3 to 0.9 fraction of the gasifier 10 internal radius as seen in plan view.

FIG. 5A is a schematic plan view of another embodiment of the invention which incorporates the conventional on-axis, circular slag tap 12 but with an added feature of a pedestal 34 located concentrically therewith. FIG. 5B is a sectional view of this embodiment taken along line 5B of FIG. 5A. The surface of the pedestal 34 is raised above the slag tap 12 opening thereby forming an annulus 36 therebetween. The pedestal 34 is, like the hearth 11, cooled by cooling coils (not shown) circulating water through the central structure. The pedestal 34 is structurally secured to the floor of the water bath 20 and the cooling coils are supplied with water from a source external thereto. The pedestal 34 protects the slag tap 12 from direct impingement of the slag jet 18 falling along the central axis 14 of the gasifier 10. Additionally, the pedestal 34 breaks up large chunks of slag and provides an increased reaction time for enhanced carbon conversion. The slag 18 then flows through the annular space 36, through the slag tap 12 and into the water bath 20. The total area of the annular space 36 is preferably at least 0.05 fraction of the total area of the hearth 11.

The foregoing description of the invention is merely intended to be explanatory thereof, and various changes in the details of the described method and apparatus may be made within the scope of the appended claims without departing from the spirit of the invention.

What is claimed is:

1. An apparatus for preventing slag tap blockage in a gasifier during the conversion of carbonaceous fuels comprising:

a reaction vessel having a hearth;

a burner in said reaction vessel for converting a dry fuel into synthesis gas and a free-flowing liquid mineral waste, said dry fuel comprising finely divided particles; and a slag tap opening in said hearth for diverting said liquid mineral waste through said hearth and from said reaction vessel, said slag tap being oval in shape, having a ratio of major-to-minor axes of from about 1.1 to 3.0 and wherein the outermost edge of said slag tap is displaced from the gasifier axis by a distance of from about 0.3 to 0.9 fraction of the gasifier internal radius as seen in plan view.

* * * * *